United States Patent [19]

Kruse

[11] Patent Number: 4,702,478

[45] Date of Patent: Oct. 27, 1987

[54] COLLAPSIBLE GOAL FRAME

[76] Inventor: Charles F. Kruse, 7343 W. 110th St., Bloomington, Minn. 55438

[21] Appl. No.: 856,198

[22] Filed: Apr. 28, 1986

[51] Int. Cl.[4] ..... A63B 71/00

[52] U.S. Cl. ..... 273/127 B; 273/410; 135/107; 135/101

[58] Field of Search ..... 273/26 A, 127 R, 127 B, 273/400, 411, 410; 135/106, 107, 108, 112, 101

[56] References Cited

U.S. PATENT DOCUMENTS

| | | | |
|---|---|---|---|
| 1,214,979 | 2/1917 | Von Ahnew | 135/108 |
| 2,449,708 | 9/1948 | Lindsay | 273/127 B |
| 3,929,147 | 12/1975 | Roscoe | 135/107 |
| 4,506,688 | 3/1985 | Bothoon et al. | 135/112 |

FOREIGN PATENT DOCUMENTS

| | | | |
|---|---|---|---|
| 908679 | 8/1972 | Canada | 273/127 B |
| 945760 | 1/1964 | United Kingdom | 273/127 R |

OTHER PUBLICATIONS

"Cleo-Lerners Aids", 2/28/76, p. 21.

*Primary Examiner*—Richard C. Pinkham
*Assistant Examiner*—T. Brown

[57] ABSTRACT

A collapsible goal frame having a crossbar, four uprights, two rear crossmembers and four sidemembers. The crossbar is detachable from sockets on the front uprights and pulls apart into three members of equal length and uniform diameter held together by an elastic cord threaded through the members. Uprights and crossmembers consist of telescoping members which are held in extended position by spring buttons. Telescoping members are retracted to collapse the frame. Four hinges join the sidemembers to the rear crossmembers, so that after the telescoping members are retracted, sides fold parallel to rear crossmembers. Lower sidemembers are weighted to add stability.

10 Claims, 6 Drawing Figures

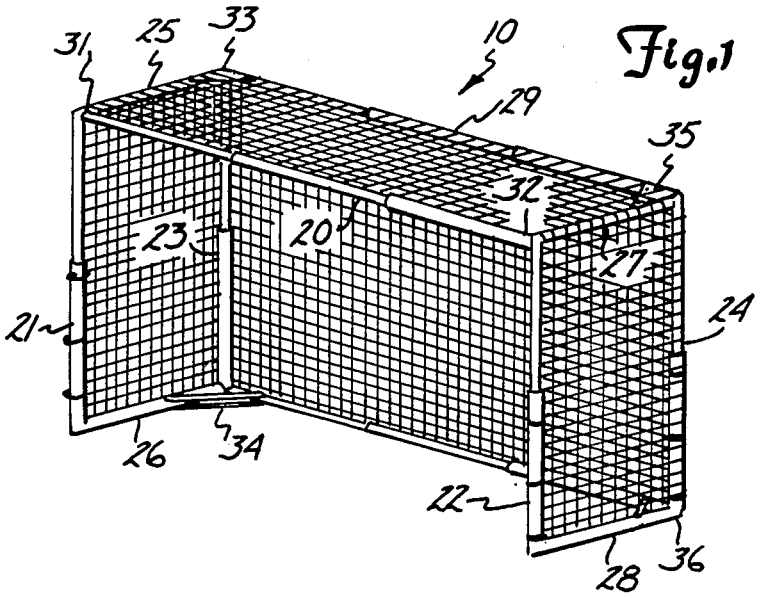
Fig. 1
Fig. 2
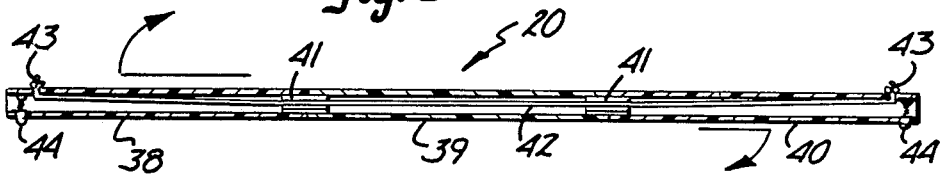
Fig. 3
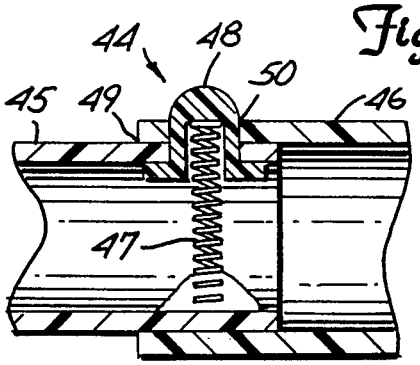

COLLAPSIBLE GOAL FRAME

This invention relates to hockey goals. Young children have long played informal variations of hockey in streets, parks, and on snow, using balls, brooms and other imaginative substitutions for the basic equipment. Many older children and adults now play these games with equal enthusiasm, and they demand more sophisticated equipment.

A design for a street hockey goal must reflect the spontaneity of these games. A goal should be easy to carry, able to stand unanchored on a flat surface, be able to absorb the impact of a ball without sliding or tipping, and provide a good target for any ball the players may choose.

Some street hockey goals are molded into an erect shape out of plastic or aluminum. They are lightweight, but their awkward shape makes them difficult to package, store, carry or transport. To overcome these problems, some goals are designed to fold or be disassembled. However, what they gain in portability they often lose in size and sturdiness. Often these designs achieve compactness in their folded positions only if the erect goal is small. Many folding designs allow for only two or three uprights.

This goal frame provides a large and sturdy goal which collapses into a compact size. It has four uprights to provide sturdiness, balance, and a simple collapsing action. The lower sidemembers are weighted to help prevent moving or tipping.

The crossbar consists of three pieces of tubing of equal length and uniform diameter. The left and right pieces fit snugly over short extensions projecting from the ends of the center piece. An elastic cord is threaded through the pieces, stretched, and anchored to the ends of the left and right pieces. The tension this creates helps prevent the assembled pieces from coming apart. The crossbar provides rigidity to the goal when attached to sockets on the upper ends of the front uprights. The crossbar is detached from the uprights before the rest of the goal is collapsed. The three pieces pull apart and can be laid parallel to each other without greatly increasing the tension in the cord. The cord prevents the three pieces from being separated from each other when the frame is stored.

After the crossbar is detached, the rest of the frame is collapsed by telescoping action. The uprights each consist of two telescoping pieces of tubing of equal length. The four uprights retract simultaneously to a goal frame of half the height. Players have the option of using the goal frame in this position with the crossbar attached. The rear upper and lower crossmembers consist of three telescoping pieces of tubing of equal length so that the two crossmembers retract simultaneously to a goal frame of one-third the width.

The sidemembers are hinged to the rear crossmembers so that the right side folds flat across the rear crossmembers, and the left side then folds flat across the right side.

FIG. 1 is an isometric view illustrating the goal frame in an erect position with the net attached.

FIG. 2 is a cross-section of the length of the crossbar, showing the three tubular members, extensions for overlap, elastic cord and spring buttons.

FIG. 3 is a detailed cross-section of the spring button mechanism.

FIG. 7 shows an erect goal with directional indications of the stages of collapse.

Figure 4:
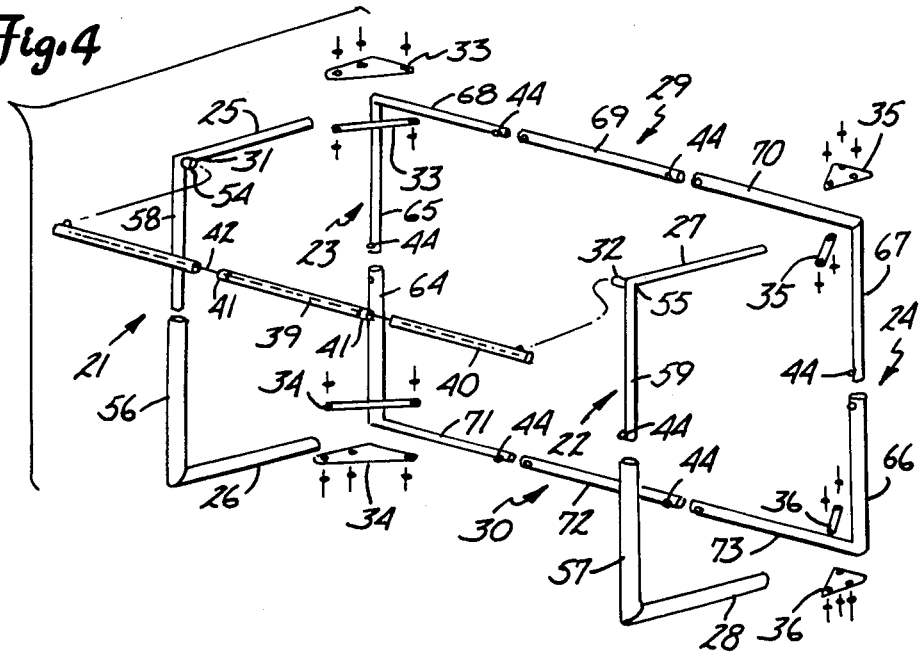
FIG. 4 is an exploded view of the frame's components.

FIG. 8*a* is a top view of the frame in an erect position and illustrates the comparative sizes of the hinges.

FIG. 8*b* is a top view of the frame in a collapsed position, with telescoping members retracted and sidemembers folded.

Referring now to the drawings, FIG. 1 shows the collapsible goal frame 10 in an erect position in accordance with the invention. As illustrated when erect, the frame 10 comprises a horizontal crossbar 20, vertical uprights 21, 22, 23 and 24, horizontal sidemembers 25, 26, 27 and 28, and horizontal rear crossmembers 29 and 30. Crossbar 20 is attached to frame 10 when the goal is erect by sliding it into sockets 31 and 32 as will be described. Uprights 21, 22, 23 and 24, and crossmembers 29 and 30 consist of telescoping members as will be described.

Sidemembers 25, 26, 27 and 28 are attached to rear crossmembers 29 and 30 by hinges 33, 34, 35 and 36 as will be described.

Crossbar 20, front uprights 21 and 22, lower sidemembers 26 and 28 and lower crossmember 30 support net 37 which is supplied separately from frame. Net 37 lays over upper sidemembers 25 and 27, upper crossmember 29 and rear uprights 23 and 24.

The assembly of crossbar 20 is illustrated in FIG. 2. The crossbar 20 consists of three tubular members 38, 39 and 40 each of approximately 23"(58.9 cm) in length and $1\frac{1}{4}$"(3.2 cm) in diameter. Center member 39 has two extensions 41. Each extension 41 consists of a 2"(5.12 cm) length of 1"(2.56 cm)-diameter tubing, glued inside center member 39 so as to extend 1"(2.56 cm) out the end. Left member 38 and right member 40 will fit snugly over the the extensions to form crossbar 20. Sockets 31 and 32 are 2"(5.12 cm) pieces of $1\frac{1}{2}$"(3.84 cm)-diameter tubing welded to L-joints 54 and 55 and extending crosswise (FIG. 4). Left and right members 38 and 40 will fit snugly into sockets 31 and 32 and will be kept from sliding out by spring button mechanisms 44, to be described.

FIG. 2 also shows how elastic cord 42 is threaded through members 38, 39 and 40. Elastic cord 42 is 5'(1.5 m) of elastic shock cord stretched to 6'(1.8 m) and anchored as shown in FIG. 2 to the ends of members 38 and 40 by pop rivet 43.

FIG. 1 shows the crossbar 20 in its assembled position. In the first stage of collapse of frame 10 (FIG. 7), crossbar 20 is detached from sockets 31 and 32 by releasing spring buttons 44. The pieces 38, 39 and 40 are then pulled apart as indicated in FIG. 4 and can be laid parallel without substantially increasing the tension in elastic cord 42.

FIG. 3 illustrates the spring button mechanism 44 which locks telescoping members to be described in their extended positions. At a telescoping action, a smaller tube 45 fits snugly into a larger tube 46. Fiberglass spring 47 is riveted inside tube 45. Spring tension causes button 48, welded to spring 47, to protrude a through hole 49 in small tube 45, and further through a hole 50 in large tube 46. Holes 49 and 50 are placed 1"(2.56 cm) from the ends of their respective tubes, causing the spring button 44 to lock in place leaving a 1"(2.56 cm) overlap of large tube 46 over the small tube 45. To release spring button 44, button 48 is depressed through hole 50 so that large tube 46 can slide over button 48.

FIG. 4 shows the preferred assembly of the remaining tubular members. The preferred embodiment of all tubular members is polypropylene tubing of ¼"(0.64 cm) thickness.

Front uprights 21 and 22 each consist of one upper member 58 and 59 25"(64 cm) long and 1¼"(3.2 cm) diameter telescoping into lower members 56 and 57 25"(64 cm) long and 1½"(3.84 cm) in diameter with a spring button 44. Upper members 58 and 59 are welded at 90 degrees to side members 25 and 27 respectively, which are 23"(58.9 cm) long and 1¼"(3.2 cm) diameter. These welded pieces form L-joints 54 and 55. As described earlier, sockets 31 and 32 are welded to L-joints 54 and 55. Lower members 56 and 57 are welded at 90 degrees to lower sidemembers 26 and 28 respectively, which are 23"(58.9 cm) long and 1½"(3.84 cm) in diameter.

Rear uprights 23 and 24 each consist of one upper member 65 and 67 25"(64 cm) long and 1¼"(3.2 cm) in diameter telescoping into lower members 64 and 66 25"(64 cm) long and 1½"(3.84 cm) in diameter with a spring button mechanism 44.

Rear crossmembers 29 and 30 consist of three telescoping members with a spring button 44 at each telescoping action. Left members 68 and 71 are 25"(64 cm) long and 1"(2.56 cm) in diameter. 68 and 71 are welded at 90 degrees to upright members 65 and 64 respectively. Center members 69 and 72 are 25"(64 cm) long and 1¼"(3.2 cm) in diameter. Right members 70 and 73 are 25" (64 cm) long and 1½"(3.84 cm) in diameter. Right members 70 and 73 are welded at 90 degrees to upright members 67 and 66 respectively. Hinges 33, 34, 35, and 36 rivet sidemembers to rear crossmembers to be described.

Figure 5:
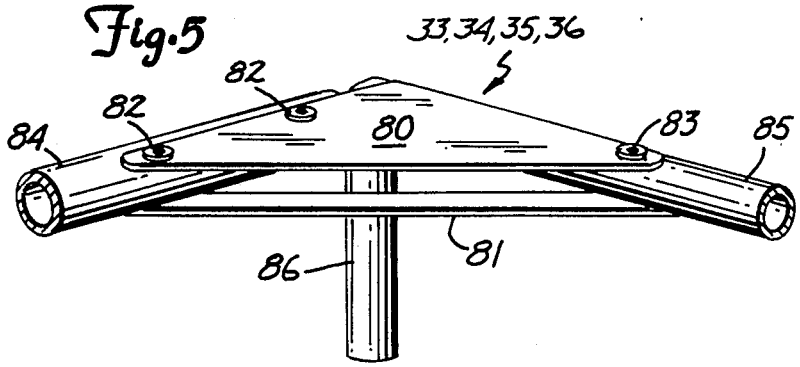
FIG. 5 is a detailed illustration of the hinges.

FIG. 5 illustrates hinges 33, 34, 35 and 36. Each hinge consists of two hinge plates 80 and 81. Plate 80 is riveted on the outer side of a sidemember 84 and a rear crossmember 85. Plate 80 is triangular in shape to allow for two rivets 82 to anchor plate 80 to a sidemember 84. Rivet 83 secures plate 80 to a rear crossmember 85. Hinge pivots on rivet 83 as shown in top view 8*b*.

Plate 81 is a rectangular plate riveted to inner side of a sidemember 84 and a rear crossmember 85. It is secured by one rivet 82 and rivet 83 so as not to interfere with an upright member 86 while pivoting.

Left hinges 33 and 34 rivet left sidemembers 25 and 26 to rear left members 68 and 71 respectively. Right hinges 35 and 36 rivet right sidemembers 27 and 28 to rear right members 70 and 73 respectively. Left hinges 33 and 34 are larger than right hinges 35 and 36 as shown in top view FIG. 8*a*. Right hinges 35 and 36 are riveted in such a way as to cause sidemembers 25 and 26 to lay flat against rear crossmembers 70 and 73 when pivoted in final stage of collapsing frame 10. Left hinges 33 and 34 are riveted in such a way as to cause sidemembers 27 and 28 to stand apart from rear crossmembers 70 and 73 so that after right sidemembers are folded flat across rear crossmembers, left sidemembers fold flat across right sidemembers, as shown in top view FIG. 8*b*.

Figure 6:
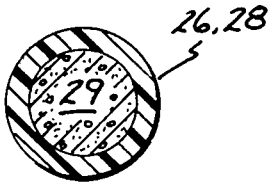
FIG. 6 is a cross-section of the lower sidemembers showing the heavy matter inside.

FIG. 6 depicts a cross-section of lower sidemembers 26 and 28. Sidemembers 26 and 28 are filled with cement or other heavy matter 29 to add weight.

FIGS. 7 and 8 show th collapsing action of goal frame 10. In FIG. 7, in the first stage of collapse crossbar 20 is detached from sockets 31 and 32 as described earlier. Crossbar members 38, 39 and 40 are pulled apart and laid parallel as described earlier. In the second stage, spring buttons 44 are released and upright members 58, 59, 65 and 67 are retracted into lower upright members 56, 57, 64 and 66 respectively. In the third stage, spring buttons 44 are released and left rear crossmembers 68 and 71 are retracted into center members 69 and 72, which in turn are retracted into right members 70 and 73. Finally, as decribed above, right front upright member 57 pivots on right hinges 35 and 36 so that right sidemembers 27 and 28 lay parallel to rear crossmembers 70 and 73. Left front upright member 56 pivots on left hinges 33 and 34 so that left sidemembers 25 and 26 lay parallel to folded right sidemembers 27 and 28. FIG. 8*b* shows a top view of frame 10 in the collapsed position.

I claim:

1. A collapsible sports goal having a net and a frame, said frame comprising:

a. a pair of front and a pair of rear hollow substantially vertical uprights, each of said uprights being comprised of two telescoping members and having means locking said telescoping members into an extended position, each of said front uprights having a short hollow extension forming a socket extending substantially perpendicular from its upper end;

b. a pair of upper and a pair of lower substantially horizontal side members, said side members having one end thereof attached to respective upper and lower ends of said front uprights, said side members further extending rearward and having the other end thereof abutting corresponding upper and lower ends of said rear uprights and attached thereto, said lower sidemembers having matter inside to add weight thereto;

c. one upper and one lower hollow substantially horizontal rear crossmember, the said upper crossmember extending crosswise between and attached to upper ends of said rear uprights, and said lower crossmember extending crosswise between and attached to lower ends of said rear uprights, said crossmembers each being comprised of three telescoping members with means locking said telescoping members into an extended position;

d. four hinges, each hinge being comprised of a pair of hinge plates and joining a said side member with a corresponding rear cross member into a movable relationship;

e. a substantially horizontal crossbar extending crosswise between upper ends of said front uprights, said crossbar being comprised of a pair of hollow end members and a hollow center member telescopically joined to said end members, an elastic cord, said elastic cord being threaded through said center member, stretched, and having its ends extending into and attached to said end members, said crossbar being detachable from said sockets on said front uprights, said net being attached to said frame members and extending over the area defined by said frame members except for an area defined by said front uprights and said crossbar extending between the upper ends thereof.

2. A goal frame according to claim 1 wherein said end members are of approximately equal length and diameter, said center member having end sections of smaller diameter than the central section thereof and forming short extensions at each end such that said end members fit snugly over said extensions, forming a substantially linear crossbar, said sockets formed on said front uprights by said short extensions having an outer diameter smaller than the inner diameter of said end members of said crossbar and being fitted in an end of said end members, means locking said telescoping upright members and said upper and lower cross members into position, said crossbar being detachable from said uprights.

3. A goal frame according to claim 2 wherein said locking means is comprised of a spring button mechanism, said spring button is riveted inside said smaller diameter telescoping member a short distance from the end thereof, with spring means biasing said spring button to protrude through a hole in said smaller diameter telescoping member, said larger diameter tubular member having a hole a short distance from its end such that when said smaller diameter tubular member is telescoped into said larger diameter tubular member in proper alignment, said spring button will snap up through said hole in larger diameter tubular member preventing further extension or retraction, with separation of said telescoping member, said tubular members being unlocked by pressing down said button though said hole in larger tubular member so that said larger tubular member can slide over said spring button.

4. A goal frame according to claim 3 wherein said uprights each are comprised of an upper and lower tubular member of approximately equal length, said upper tubular member being of smaller diameter than said lower tubular member such that said upper tubular member telescopes into said lower tubular member, said front and rear uprights being retracted simultaneously by simultaneously unlocking said spring button mechanisms and fully retracting said upper tubular members into said lower tubular members.

5. A goal frame according to claim 4 wherein said side members each is comprised of one tubular member, each of said upper and lower sidemembers having one of its ends welded to corresponding said upper and lower tubular members of said front uprights forming four L-shaped joints.

6. A goal frame according to claim 5 wherein said lower side members are permanently filled with said heavy matter to help prevent moving or tipping when said frame is erect.

7. A goal frame according to claim 6 wherein each of said rear cross members is hollow and is comprised of a leftmost, rightmost and center tubular member of approximately equal length, said leftmost tubular member being of smaller diameter than said center tubular member, which in turn is smaller in diameter than said rightmost tubular member such that said leftmost tubular member telescopes into said center tubular member, which in turn telescopes into said rightmost tubular member, said tubular members being locked into an extended position by said spring button mechanisms, said upper and lower rear crossmembers being retracted simultaneously by simultaneously unlocking said spring button mechanisms and fully retracting said leftmost tubular members into said center tubular members and in turn fully retracting said center tubular members into said rightmost tubular members.

8. A goal frame according to claim 7 wherein each of said leftmost and rightmost tubular members of said upper and lower crossmembers are welded to corresponding said upper and lower tubular members of said rear uprights forming four L-shaped joints.

9. A goal frame according to claim 8 wherein one of said plates of each of said pair of said hinge plates is riveted twice to an upper and a lower said side member and once to a said upper and lower rear cross member and on the respective top and bottom side of said upper and lower side members and rear cross members, the other plate of each of said pair of hinge plates being riveted once to said side member and a rear cross member and on the respective bottom and top side of said upper side member and rear cross member and lower side member and rear cross member, said frame being collapsible by detaching said cross bar from said front upright sockets, pivoting said side members relative to said rear cross bars and unlocking said spring button mechanisms for telescopically retracting said uprights and rear cross members.

10. A goal frame according to claim 9 wherein said side members abut said rear cross members so that when said hinges are riveted into place said side members can swing out no more than ninety degrees from said rear cross members.

* * * * *